US008931297B2

(12) United States Patent
Marega

(10) Patent No.: US 8,931,297 B2
(45) Date of Patent: Jan. 13, 2015

(54) COOLING APPARATUS CONDENSER, AND A COOLING APPARATUS INCLUDING THE SAME

(75) Inventor: Paolo Marega, Cordenons (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 869 days.

(21) Appl. No.: 12/999,355

(22) PCT Filed: Jun. 16, 2009

(86) PCT No.: PCT/EP2009/004330

§ 371 (c)(1),
(2), (4) Date: Mar. 10, 2011

(87) PCT Pub. No.: WO2009/153024

PCT Pub. Date: Dec. 23, 2009

(65) Prior Publication Data

US 2011/0154846 A1 Jun. 30, 2011

(30) Foreign Application Priority Data

Jun. 20, 2008 (EP) ..... 08158685

(51) Int. Cl.
*F25D 21/14* (2006.01)
*F25D 23/00* (2006.01)
(Continued)

(52) U.S. Cl.
CPC ..... *F25D 23/006* (2013.01); *F25B 39/04* (2013.01); *F25B 2500/01* (2013.01); *F25D 21/14* (2013.01); *F25D 2321/1442* (2013.01); *F28D 1/0477* (2013.01); *F28F 1/122* (2013.01); *F28F 9/002* (2013.01)
USPC ..... 62/291; 165/171

(58) Field of Classification Search
CPC ..... F25B 39/04; F25B 2321/143; F25B 2321/144; F25B 2321/1442; F25B 2321/1441
USPC ..... 62/291, 453, 505; 165/171
See application file for complete search history.

(56) References Cited

U.S. PATENT DOCUMENTS 1,362,757 A 12/1920 Douglas
2,081,970 A * 6/1937 Alther ..... 208/132
(Continued)

FOREIGN PATENT DOCUMENTS

DE 1174339 7/1964
FR 2099803 3/1972
(Continued)

OTHER PUBLICATIONS

International Search Report for PCT/EP2009/005330, dated Oct. 13, 2009, 3 pages.

*Primary Examiner* — Ljiljana Ciric
*Assistant Examiner* — Alexis Cox
(74) *Attorney, Agent, or Firm* — Pearne & Gordon LLP

(57) ABSTRACT

A cooling apparatus includes a cabinet (100) defining a compartment for the storage of products to be cooled and a cooling system coupled to the cabinet for cooling an interior atmosphere of the compartment. The cooling system includes at least one condenser (130) and at least one compressor (125) positioned in a recess of the cabinet. The condenser has at least a first condenser portion (150) adapted to define a support surface for the at least one compressor, wherein the compressor is supported by the first condenser portion, and wherein the condenser has a second condenser portion (145) completely covering a rear of the recess.

14 Claims, 3 Drawing Sheets

(51) Int. Cl.

| | |
|---|---|
| *F28F 1/32* | (2006.01) |
| *F25B 39/04* | (2006.01) |
| *F28D 1/047* | (2006.01) |
| *F28F 1/12* | (2006.01) |
| *F28F 9/00* | (2006.01) |

(56) References Cited

U.S. PATENT DOCUMENTS

| | | | | | |
|---|---|---|---|---|---|
| 2,091,584 | A | * | 8/1937 | Brown | 62/520 |
| 2,263,068 | A | * | 11/1941 | Burggrabe et al. | 62/513 |
| 2,311,947 | A | | 2/1943 | Kucher | |
| 2,659,213 | A | * | 11/1953 | Hart | 62/451 |
| 3,035,421 | A | * | 5/1962 | Halbeisen | 62/426 |
| 4,270,596 | A | * | 6/1981 | Zinn et al. | 165/46 |
| 4,490,990 | A | | 1/1985 | Chastine et al. | |
| 5,042,565 | A | * | 8/1991 | Yuen et al. | 165/41 |
| 5,117,523 | A | * | 6/1992 | Jacobus et al. | 62/259.1 |
| 5,966,958 | A | * | 10/1999 | Maynard | 62/277 |
| 6,804,976 | B1 | * | 10/2004 | Dain | 62/525 |
| 2007/0130987 | A1 | | 6/2007 | Shimizu | |

FOREIGN PATENT DOCUMENTS

| | | |
|---|---|---|
| GB | 338447 | 11/1930 |
| JP | 2000146384 | 5/2000 |
| JP | 2003322456 | 11/2003 |

* cited by examiner

COOLING APPARATUS CONDENSER, AND A COOLING APPARATUS INCLUDING THE SAME

BACKGROUND OF THE INVENTION

1. Field of the Invention

The present invention generally relates to cooling apparatuses, particularly for food and beverage storage, such as refrigerators and/or freezers for e.g. domestic use. More specifically, the present invention concerns the construction of condensers for cooling apparatuses in general and for refrigerators/freezers in particular.

2. Discussion of the Related Art

Refrigerators for foods and beverages generally comprise a cabinet with at least one cooling compartment for storing the articles to be kept cool, like for example vegetables, fruit, dairy products, meat, beverages in bottles or cans. The cooling compartment is open frontally, or at the top, and a door enables access to the interior of the compartment.

Associated with the cabinet is a cooling system operable to keep the interior of the cabinet, particularly the cooling compartment, cold. The cooling system typically comprises at least one compressor, one condenser and one evaporator; the compressor, condenser and evaporator are in fluid communication by means of a piping and altogether form a closed hydraulic circuit, which is circulated through by a cooling agent.

In operation, the cooling agent circulates through the closed circuit from the compressor through the condenser and the evaporator and back to the compressor. The cooling agent is first compressed by the compressor, which raises the cooling agent pressure (and temperature). Then, the cooling agent flows to the condenser, where its temperature is decreased, causing it to change phase and pass from the gaseous to the liquid one; in this phase change, the cooling agent releases heat, that is dissipated by the condenser and released to the environment. Passing to the evaporator, which is located inside the refrigerator compartment (for example formed in the lining of the refrigerator compartment), the cooling agent evaporates, subtracting heat from the atmosphere within the refrigerator compartment and thus cooling the interior thereof.

In refrigerators having also a freezer compartment, for the long-term storage of frozen articles, an additional evaporator is provided for the freezer compartment, or possibly a separate cooling system may be provided for (with a compressor, a condenser and an evaporator dedicated to the freezer).

In a typical refrigerator, the compressor is accommodated in a recess formed in a bottom part of the cabinet at the rear thereof. The compressor is attached, through elastic elements adapted to dump vibrations, to a metal support that is in turn connected to side panels of the refrigerator cabinet. The condenser essentially comprises a winding tube or serpentine coil (for example of steel) with interconnection fins or wires (also made of steel and spot-welded to the coil) arranged to form a substantially flat grid, and is mounted vertically to the back of the refrigerator cabinet, above the compressor, using brackets.

The conventional arrangement of parts described above is for example shown in WO 2004/081473, in EP 125642 and in EP 364985.

Different solutions are described in U.S. Pat. No. 5,502,983 and GB 450299.

In U.S. Pat. No. 5,502,983 a refrigerator condenser coil and a related manufacturing method are described; the serpentine coil, to which wires are attached, is folded into a U shape, to allow for cross flow of air through and around the condensing coil.

In GB 450299, a refrigerator condenser is described having a lower edge bent inwardly, forming a horizontal lower strengthening flange, a center bowed outwardly, to have an arcuate shape, and with vertical edges bent outwardly to form reinforcing flanges.

SUMMARY OF THE INVENTION

The Applicant has observed that the traditional solution adopted for mounting the compressor and the condenser to a refrigerator cabinet is not totally satisfactory.

In particular, the fact that the different components of the cooling system (compressor, condenser, interconnection tubes) are separated parts that are assembled during the refrigerator assemblage has an impact on the manufacturing time, and also complicates the inventory management, ultimately increasing the costs.

Also, the use of distinct parts for mounting the components of the cooling system to the refrigerator cabinet (the metal support for the compressor, the brackets for the condenser) is undesirable, because it increases the parts number (and thus the overall final cost) and the manufacturing time.

In addition, the compressor area is usually left exposed and thus unprotected against accidental impacts, that might damage the cooling system.

In view of the state of the art outlined above, the Applicant has tackled the problem of devising an improved solution that is not affected, or is less affected, by the above-mentioned problems.

The Applicant has found that by providing a cooling apparatus, e.g. a refrigerator with a condenser having a portion that lies horizontally and defines a lower plate for supporting the compressor, the above problems can be solved and an easy-to-assemble, cheap and reliable refrigerator can be realized. For example, the condenser may be a generically L-shaped, essentially flat condenser, with one portion of the condenser, i.e. one leg of the "L", lying vertically, as in the traditional arrangements, and the other portion of the condenser, i.e. the other leg of the "L", lying horizontally and defining a lower plate for supporting the compressor.

Therefore, according to an aspect of the present invention, a cooling apparatus is provided, comprising:

- a cabinet defining a compartment for the storage of products to be cooled; and
- a cooling system coupled to the cabinet for cooling an interior atmosphere of the compartment.

The cooling system comprises at least one condenser and at least one compressor.

The condenser comprises at least a first condenser portion adapted to define a support surface for the at least one compressor, and the compressor is supported by said first condenser portion. In particular, the compressor may be fastened to said first condenser portion by means of brackets.

In particular, the first condenser portion is mounted at a bottom of said cabinet.

According to another aspect of the present invention, a condenser for a cooling system of a cooling apparatus is provided, characterized by comprising at least a first condenser portion substantially lying in a first plane and adapted to define a support surface for at least one compressor of the cooling system.

Still another aspect of the present invention relates to a cooling system for a cooling apparatus is provided, comprising a condenser and at least one compressor, wherein the condenser comprises at least a first condenser portion substantially lying in a first plane and adapted to define a support surface for the at least one compressor, and wherein the compressor is supported by and attached to the second condenser portion.

In exemplary, non-limitative and possibly preferred embodiments of the above-mentioned aspects of the present invention, the first condenser portion substantially lies in a first plane, and the condenser comprises a second condenser portion substantially lying in second plane forming an angle with the first plane.

The first and second condenser portions may be substantially perpendicular to the first condenser portion; the second condenser portion may be mounted parallel to a rear vertical wall of said cabinet.

The first and second condenser portions may be both generically rectangular, the second condenser portion having a surface greater than a surface of the first condenser portion.

A longer side of the first condenser portion may have a same length as a shorter side of the second condenser portion.

The condenser may further comprise brackets for the attachment of the condenser to a cabinet of the cooling apparatus.

The cooling system may further comprise a defrost water collection tray adapted to collect defrost water of the cooling apparatus, the defrost water collection tray being accommodated on the second condenser portion aside the compressor.

An additional aspect of the present invention concerns a method for producing a cooling system for a cooling apparatus, comprising forming a condenser having at least a first condenser lying in a first plane and adapted to define a support surface for at least one compressor of the cooling system; and positioning and attaching to the first condenser portion a compressor for the cooling agent.

The condenser may have a second condenser portion forming an angle, particularly of 90°, with the first condenser portion.

The first and second condenser portions may be mutually bent parts obtained by bending a single condenser piece.

Alternatively, the first and second condenser portions may be physically distinct parts mechanically and hydraulically interconnected to one another.

Thanks to the present invention, the conventional metal support used for mounting the compressor to the refrigerator cabinet is no longer necessary, because the condenser itself is used as a compressor support. This simplifies the assemblage of the refrigerator, and reduces the number of distinct parts, thereby leading to a reduction of production costs.

Thanks to the fact that the compressor is supported by and attached directly to the condenser, this subsystem of the cooling system (compressor, condenser, filter, tubes, control unit) may be provided as a preassembled module. This may be expedient from the refrigerator assemblage point of view.

The compressor area is protected against unintentional impacts that could damage the cooling system.

The possibility of accommodating a tray for the defrost water on the condenser facilitates the evaporation of the defrost water, thanks to the heat dissipated by the condenser.

The manufacturing of the condenser with the bent portion is easy and does not pose problems. For example, the condenser may be initially realized in the form of an essentially flat grid, spot-welding the interconnection fins to the serpentine coil, and then a portion thereof may be bent to form the bent portion.

BRIEF DESCRIPTION OF THE DRAWINGS

These and other features and advantages of the present invention will be made clear by the following detailed description of an embodiment thereof, provided merely by way of non-limitative example, description that should be read in conjunction with the annexed drawings, wherein.

DETAILED DESCRIPTION OF AN EMBODIMENT OF THE INVENTION

Figure 1:
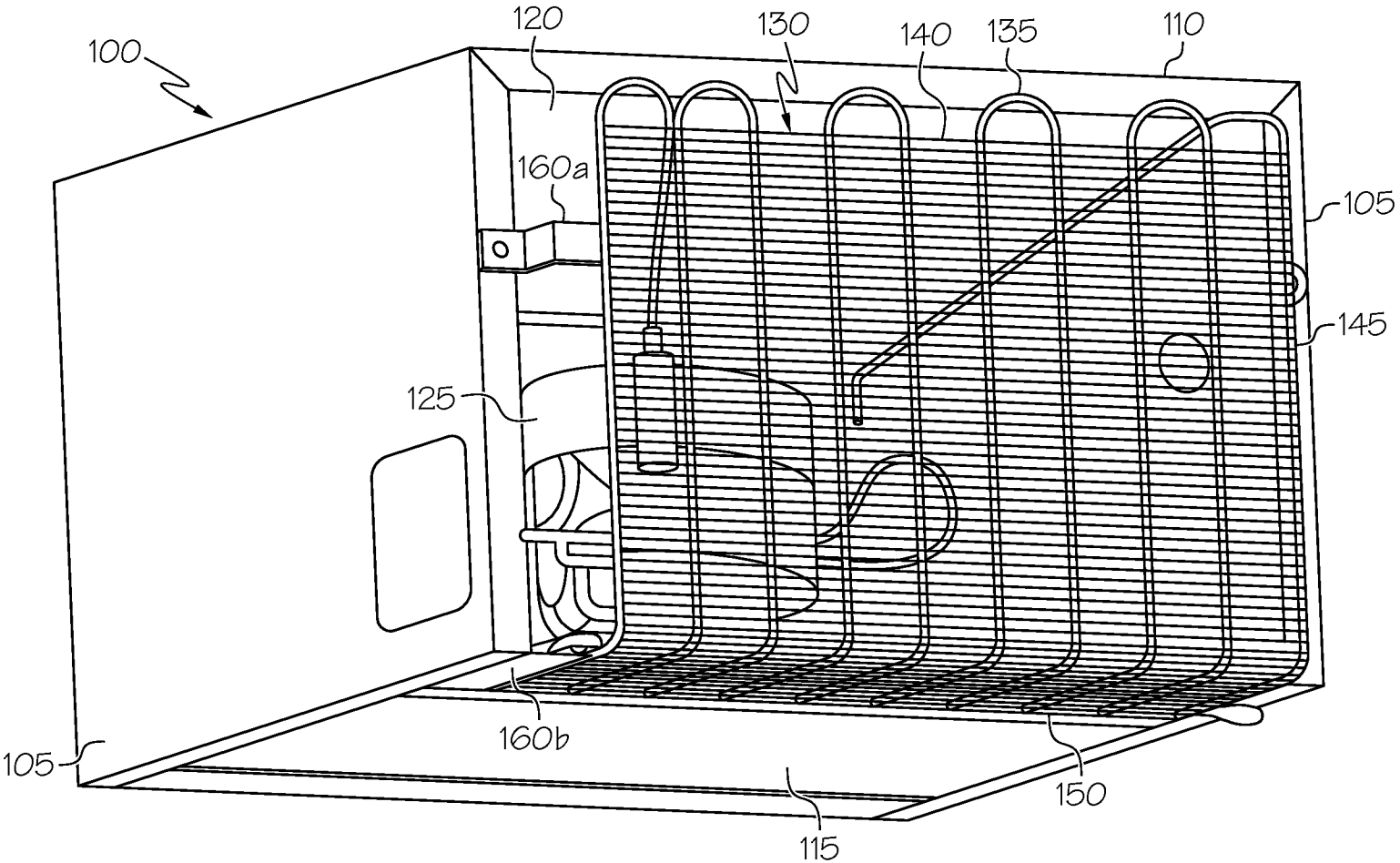
FIG. 1 shows in perspective view from the rear a refrigerator/freezer cabinet equipped with a cooling system according to an embodiment of the present invention.
Figure 2:
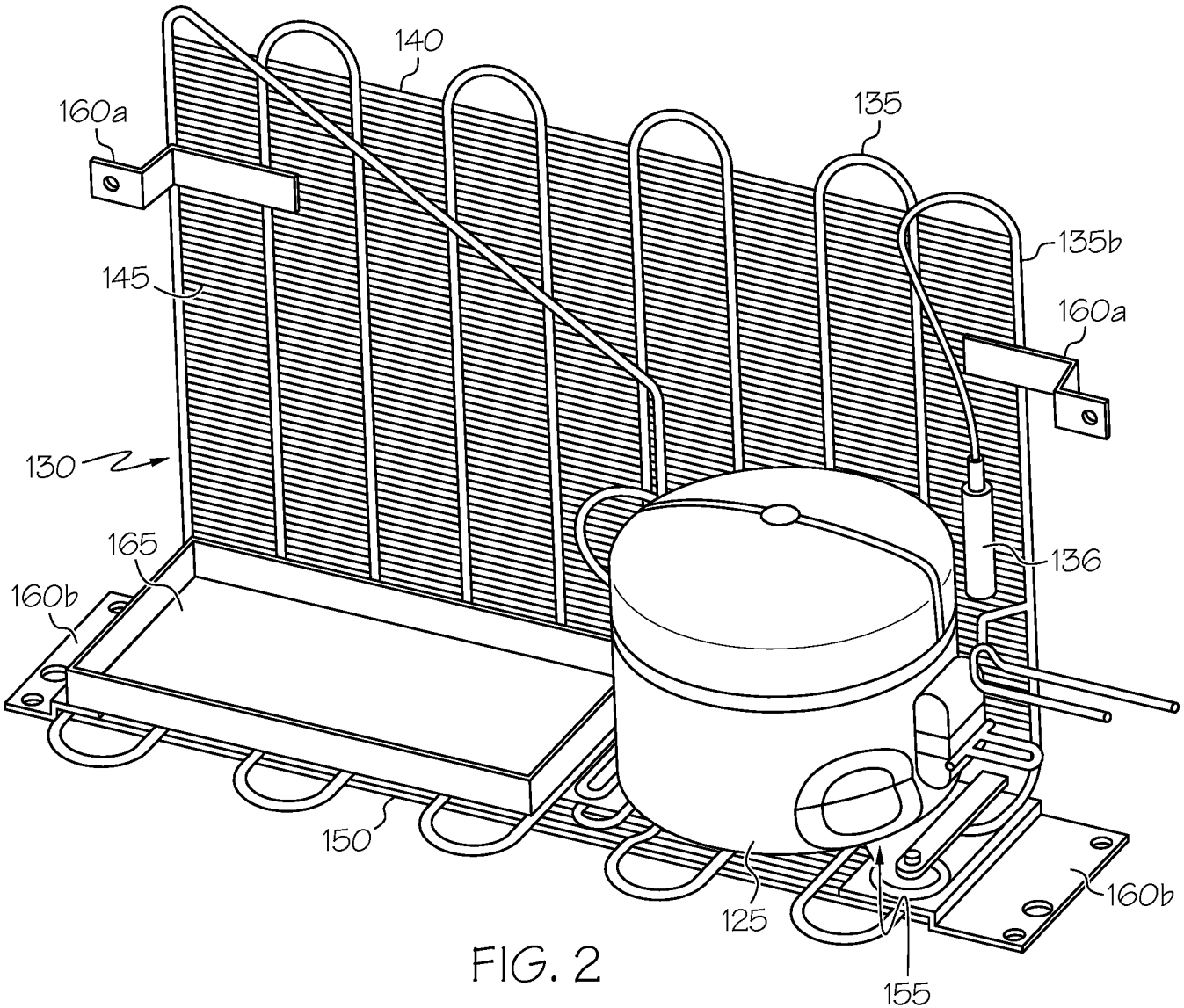
FIG. 2 shows in perspective view from the front a compressor and condenser assembly of the cooling system of FIG. 1, in an embodiment of the present invention.
Figure 3:
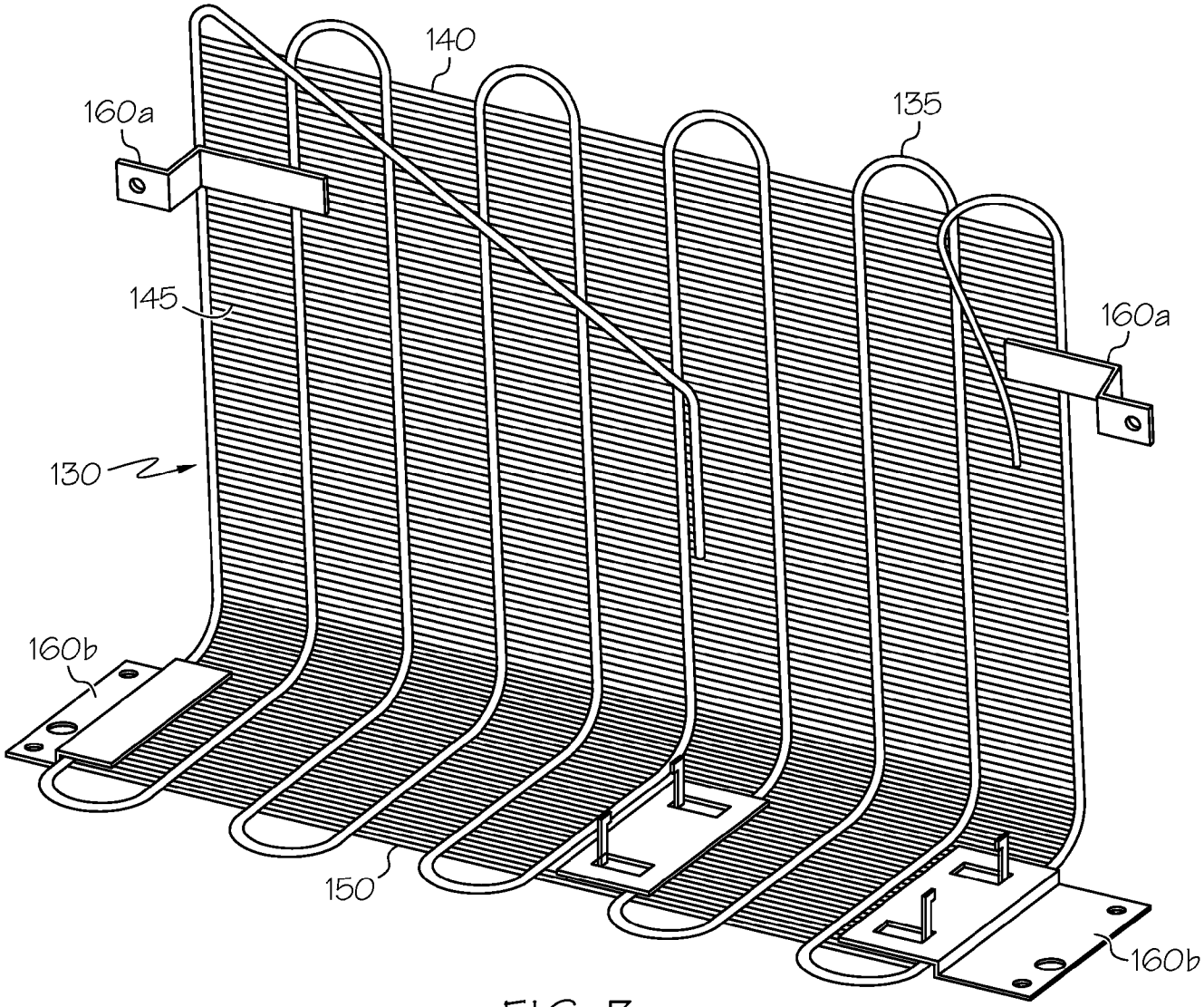
FIG. 3 shows in perspective view similar to that of FIG. 2 the condenser, separated from the compressor.

Making reference to the drawings, in FIG. 1 a cabinet 100 of a refrigerator or freezer is depicted in perspective from the rear. In particular, in the exemplary embodiment herein described a mini fridge (a small-volume refrigerator, with a capacity of the order of 20-40 liters) is considered, however this is not to be intended as a limitation for the present invention, which applies as well to normal-size refrigerators, of capacity of the order of 200-300 liters, with or without freezer compartment, and in general to any cooling apparatus.

The cabinet 100 comprises an outer shell, having generically a parallelepiped shape, with lateral panels 105, a top panel 110, a bottom plate 115 and a back plate 120.

All the panels 105, 110, 115, 120 may for example be in metal sheet or plastic.

The cabinet outer shell encloses an inner liner (not visible in the drawing), normally made of molded plastic and defining one or more compartments for the storage of the products to be refrigerated/frozen. Between the shell and the inner liner, insulation material (not shown) is preferably present, to thermally insulate the interior of the storage compartment from the outside. The cabinet 100 is also provided with at least one door (not shown in the drawings) which enables accessing the storage compartment.

Associated with the cabinet 100 is a cooling system, comprising a compressor 125, a condenser 130, a dryer 136, a capillary (not shown in the drawing), an evaporator (not visible in the drawing because internal to the storage compartment), and tubes for interconnecting them to each other so as to form a closed hydraulic circuit.

The condenser 130 comprises a serpentine coil 135, for example made of steel, with several interconnection fins or wires 140, also made for example of steel and spot-welded to the coil. The coil 135 and the interconnection wires 140 are arranged to form a grid.

According to an embodiment of the present invention, the condenser 130 comprises a generically rectangular, substantially flat portion 145, of prevailing size, and a bent portion 150 at one end of the condenser 130. The bent portion 150, which extends for the whole width of the condenser 130, is bent at an angle of approximately 90° with respect to the flat portion 145. In other words, the flat portion 145 and the bent portion 150 define two essentially flat portions of a same L-shaped flat body (the condenser 130), at a right-angle to each other. As better described in the following, in operation the flat portion 145 lies vertically and delimits the appliance on the rear, whereas the flat portion 150 lies horizontally and delimits the appliance on the bottom.

The bent portion 150 of the condenser 130 has a length sufficient to provide a support surface for the compressor 125. The compressor 125 is fixed to the bent portion 150 of the condenser 130 by means of brackets 155.

The coil 135 has extended terminal ends 135*a*, 135*b* for the connection to the hydraulic circuit, particularly to a delivery port of the compressor 125. Capillary tubes are used to connect the compressor 125 to the hydraulic circuit, and to connect the condenser 135 to the evaporator.

The condenser 130 is mounted to the cabinet 100 at the rear thereof, with the flat portion 145 extending vertically along the back plate 120, and the bent portion 150 extending horizontally below the bottom plate 115. The condenser 130 is positioned with respect to the cabinet 100 such that the compressor 125 is accommodated within a respective recess (i.e. a respective opening) formed with respect to the back and bottom plates 120 and 115 of the cabinet. The condenser 130 is attached to the cabinet 100 by means of brackets 160; in particular, (two, in example) brackets 160*a* are used to attach the flat portion 145 of the condenser (that, in use, extends vertically) to the lateral panels 105 of the cabinet 100, while (two, in the example) brackets 160*b* are used to connect the bent portion 150 (horizontal, in use) to lateral panels 105.

Advantageously, the remaining part of the bent portion 150 not occupied by the compressor 125 is used as a support for a tray 165, adapted to receive water which, in use, is originated by the defrost of storage compartment and/or the evaporator.

In use, a cooling agent fills the closed circuit of the cooling system. When the compressor is actuated (under the control of the control unit, which operates exploiting a thermostat provided within the storage compartment) the cooling agent circulates through the closed circuit from the compressor through the condenser and the evaporator and back to the compressor. The cooling agent is first compressed by the compressor, which raises the cooling agent pressure (and temperature). Then, the cooling agent flows to the condenser, where its temperature is decreased, causing it to change phase and pass from the gaseous to the liquid one; in this phase change, the cooling agent releases heat, that is dissipated by the condenser and released to the environment. Passing to the evaporator, which is located inside the refrigerator compartment (for example formed in the lining of the refrigerator compartment), the cooling agent evaporates, subtracting heat from the atmosphere within the refrigerator compartment and thus cooling the interior thereof.

The described invention embodiment is advantageous under several respects.

The conventional metal plate used as a lower support for mounting the compressor to the refrigerator cabinet is no longer necessary, because the condenser itself is used as a compressor support. This simplifies the assemblage of the refrigerator, and reduces the number of distinct parts, thereby leading to a reduction of production costs.

Thanks to the fact that the compressor is supported by and attached directly to the condenser, this subsystem of the cooling system (compressor, condenser, filter, tubes, control unit) may be provided as a preassembled module). This may be expedient from the refrigerator assemblage point of view.

The area of the recess formed in the back plate 120 of the cabinet 100 where the compressor 125 is accommodated is essentially completely covered by the condenser 130; in particular, the flat portion 145 of the condenser 130 covers the rear of the recess and the bent portion 150 of the condenser 130 covers the bottom of the recess. In this way, the compressor area (particularly, the compressor 125, its control unit, the filter, the capillary tubes) is protected against unintentional impacts that could damage the cooling system.

The possibility of accommodating a tray for the defrost water on the condenser facilitates the evaporation of the defrost water, thanks to the heat dissipated by the condenser.

The manufacturing of the condenser with the bent portion is easy and does not pose problems. For example, the condenser may be initially realized in the form of an essentially flat grid, spot-welding the interconnection fins to the serpentine coil, and then a portion thereof may be bent to form the bent portion.

The present invention is applicable to any type of refrigerator/freezer; for example, in those appliances having distinct cooling systems for different refrigerator compartments (e.g., a distinct cooling system for the freezer compartment), the two compressors may be both supported by the bent portion of one of the two condensers (the one which is mounted at the bottom of the cabinet).

The present invention has been here described in one of its possible embodiments, however those skilled in the art will recognize that several modifications to the described embodiment can be made, as well as other embodiments are possible, without departing from the protection scope defined in the appended claims.

For example, although in the embodiment described the bent portion 150 of the condenser 130 has substantially the same width as the flat portion 145, in alternative invention embodiments the bent portion 150 may have a different width, for example smaller than the width of the planar portion 130, provided that the overall size of the bent portion 150 provides a sufficient space for accommodating the compressor(s).

In alternative embodiments of the present invention, the condenser 130, instead of being realized in the form of an essentially flat grid a portion of which is subsequently bent to form the bent portion 150, i.e., instead of being made of a single piece, may be realized as two substantially flat, initially distinct parts, like two separate traditional condensers, of suitable dimensions, which are then connected mechanically and hydraulically to each other so as to form substantially a right angle. The resulting condenser thus has a first flat portion and a second flat portion lying in planes forming an angle.

In still alternative embodiments of the invention, the second flat portion of the condenser, which is arranged horizontally, may be of relatively large size, for example as large as the bottom of the refrigerator, sufficient not only to accommodate the compressor(s), but also to dissipate heat; in this case, provided the first flat portion of the condenser, i.e. the one which in the previously described embodiment is arranged vertically, may even be missing.

The invention claimed is:

1. A cooling apparatus comprising:

a cabinet (100) defining a compartment for the storage of products to be cooled; and a cooling system coupled to the cabinet for cooling an interior atmosphere of the compartment, wherein the cooling system comprises:

at least one condenser (130); and at least one compressor (125) positioned in a recess of the cabinet, wherein the condenser comprises at least a first condenser portion (150) adapted to define a support surface for the at least one compressor, and the compressor is supported by said first condenser portion, a defrost water collection tray (165) adapted to collect defrost water of the cooling apparatus, the defrost water collection tray being supported by the first condenser portion adjacent to the compressor, and wherein the defrost water collection tray (165) is placed above the first condenser portion.

2. The cooling apparatus of claim 1, wherein the recess is in a lower part of the cabinet and the first condenser portion is connected to a bottom of said cabinet and covers a bottom of the recess.

3. The cooling apparatus of claim 1, wherein the condenser further comprises brackets (160) for the attachment of the condenser to the cabinet.

4. The cooling apparatus of claim 1, wherein the compressor is fastened to the condenser.

5. The cooling apparatus of claim 4, wherein the compressor is fastened to the first condenser portion by means of brackets (155).

6. The cooling apparatus of claim 1, wherein the first condenser portion lies in a first plane and the condenser comprises a second condenser portion (145) that lies in a second plane forming an angle with the first plane.

7. The cooling apparatus of claim 6, wherein the first and second condenser portions are mutually bent parts of a single condenser piece.

8. The cooling apparatus of claim 6, wherein the first and second condenser portions are physically distinct parts mechanically and hydraulically interconnected.

9. The cooling apparatus of claim 6, wherein the second condenser portion (145) completely covers a rear of the recess.

10. The cooling apparatus of claim 6, wherein the second condenser portion (145) extends across a majority of a rear of the recess.

11. The cooling apparatus of claim 6, wherein the angle between the first plane and the second plane is a right angle.

12. The cooling apparatus of claim 11, wherein the second condenser portion is mounted parallel to a rear vertical wall of said cabinet.

13. The cooling apparatus of claim 6, wherein the first and second condenser portions are both rectangular, the second condenser portion having a surface greater than a surface of the first condenser portion.

14. The cooling apparatus of claim 13, wherein a longer side of the first condenser portion has a same length as a shorter side of the second condenser portion.

* * * * *